US008016920B2

(12) United States Patent
Kouba et al.

(10) Patent No.: US 8,016,920 B2
(45) Date of Patent: Sep. 13, 2011

(54) SYSTEM AND METHOD FOR SLUG CONTROL

(75) Inventors: Gene E. Kouba, Katy, TX (US); Shoubo Wang, Tulsa, OK (US)

(73) Assignee: Chevron U.S.A. Inc., San Ramon, CA (US)

( * ) Notice: Subject to any disclaimer, the term of this patent is extended or adjusted under 35 U.S.C. 154(b) by 414 days.

(21) Appl. No.: 12/335,060

(22) Filed: Dec. 15, 2008

(65) Prior Publication Data

US 2010/0147773 A1 Jun. 17, 2010

(51) Int. Cl.
*B01D 19/00* (2006.01)

(52) U.S. Cl. ..... 95/261; 96/212; 166/357

(58) Field of Classification Search ..... 95/261; 96/212, 210, 211, 209; 166/357
See application file for complete search history.

(56) References Cited

U.S. PATENT DOCUMENTS

| | | | | |
|---|---|---|---|---|
| 5,232,475 | A * | 8/1993 | Jepson | 95/260 |
| 5,507,858 | A | 4/1996 | Jepson | |
| 5,526,684 | A | 6/1996 | Liu et al. | |
| 6,716,268 | B2 | 4/2004 | Molyneux et al. | |
| 2002/0193976 | A1 | 12/2002 | Duret et al. | |
| 2006/0151167 | A1 * | 7/2006 | Aarvik et al. | 166/267 |
| 2008/0251469 | A1 * | 10/2008 | Tee et al. | 210/788 |

OTHER PUBLICATIONS

International Search Report and Written Opinion, International Application No. PCT/US2009/067903, dated Aug. 17, 2010.
Schmidt, Z., Brill, J.P., and Beggs, H.D.: "Experimental Study of Severe Slugging in a Two-Phase Flow Pipeline-Riser System", SPE 8306, 1980.
Havre, K. and Dalsmo, M.: "Active Feedback Control as a Solution to Severe Slugging", SPE 79252, Aug. 2002.
Molyneux, P., Tait, A., and Kinvig, J,: "Characterization and Active Control of Slugging, in a Vertical Riser", Multiphase 2000; BHRG Conference, Banff, Canada, 2000.
Kovalev, K., Cruickshank, A., and Purvis, J.: "The Slug Suppression System in Operation", SPE 84947, 2003.
Tengesdal, J.O., Thompson, L., and Sarica, C.: "A Design Approach for "Self-Lifting" Method to Eliminate Severe Slugging in Offshore Productino Systems", SPE84227, Oct. 2003.

* cited by examiner

*Primary Examiner* — Duane Smith
*Assistant Examiner* — Douglas J Theisen
(74) *Attorney, Agent, or Firm* — Nicholas F. Gallo

(57) ABSTRACT

A riser-based slug control system and a method of controlling slugging in a fluid flowing through a riser are provided. The system includes a gas-liquid separation separator that has a housing defining an internal volume. An inclined inlet is connected to the housing and configured to receive a flow of multiphase fluid and direct the flow of fluid into the housing so that the fluid flows spirally in the volume and separates, with gas from the fluid collecting in an upper portion of the volume and liquid from the fluid collecting in a lower portion of the volume. A tubular passage, which extends at least partially through the internal volume of the housing, defines a plurality of orifices. The tubular passage is configured to receive liquid from the lower portion of the volume and gas from upper portion of the volume, and deliver the mixture of the combined liquid and gas through an outlet.

24 Claims, 6 Drawing Sheets

SYSTEM AND METHOD FOR SLUG CONTROL

BACKGROUND OF THE INVENTION

1. Field of the Invention

This invention relates to the control of slugging in a line, such as severe slugging that may occur in a riser that transports production fluid from a hydrocarbon well at a seafloor to a topside facility at the sea surface.

2. Description of Related Art

Risers are commonly used in offshore piping in the hydrocarbon industry to transport production fluids from a wellhead on the seafloor to a facility at the sea surface, such as a topside separator and process facility on an offshore platform. The production fluid provided from the well and transported through the riser is often a multiphase fluid, e.g., a mixture of liquid(s) and gas(es), such as a mixture of oil, water, and natural gas. The presence of gas in the fluid can assist in lifting the fluid through the riser by reducing the hydrostatic head of liquid in the riser. Conversely, the absence of gas in the riser results in larger hydrostatic pressure and increase in the back pressure on the well. Therefore, it is generally desirable to avoid impeding the flow of gas to the riser.

An unstable phenomenon referred to as "slugging" can occur in an offshore riser when liquid flowing into the riser blocks the pipe and the hydrostatic head at the blockage temporarily builds up faster in the riser than the pressure in the trapped gas upstream of the riser. For example, FIG. 1 illustrates a production line 2 that transports production fluid to a riser 4. The production line 2 is located on the seafloor 6 and ramps slightly downward toward the riser 4, and the riser 4 extends upwards from the seafloor 6 to a facility 8 at the sea surface 10. The production line 2 and riser 4 define an angle, or pinch point 12, at the connection thereof. As shown in FIG. 1, a slug of liquid 14 has formed at the pinch point 12 and blocks the riser 4 such that gas in the production line 2 cannot flow into the riser 4. Gas in the production line 2 upstream of the pinch point 14 builds in pressure until the pressure of the gas exceeds the hydrostatic head of the liquid, and the gas then proceeds into the riser 4, moving the liquid slug 14 upward through the riser 4 and out of the riser 4 into the topside facility 8. The pressure in the fluid provided to the facility 8 can vary widely, typically decreasing as the liquid level builds and then rising quickly as the slug 14 is subsequently transported through the riser 4 to the facility 8.

The term "severe slugging" refers to an extreme type of unstable slugging, in which the liquid slug 14 fills the entire riser 4. When severe slugging occurs, the upstream gas pressure must build to a sufficient level to overcome the hydrostatic head of the liquid filling the riser 4. If the riser 4 extends upward by a great vertical distance, e.g; from seafloor to sea surface, the hydrostatic head associated with severe slugging can be significant. Severe slugging is referred to as "ultra-severe slugging" when the liquid slug blockage occurs in an upward incline of piping that is upstream of the riser, such that the riser and a length of piping upstream of the riser, sometimes miles of piping, fill with liquid before the gas pressure becomes sufficient great to overcome the hydrostatic head of the liquid and move the liquid through the riser.

The instantaneous flow rates of alternating gas and liquid in a severe slugging cycle can be much higher, in some cases more than an order of magnitude higher, than the average flow rates of the fluid through the riser. The large changes in flow rates can cause severe changes in the liquid level in the primary separator, or other facility fed by the riser 4, and can interfere with proper separation and fluid processing in the facility. In addition, the large pressure changes with the fluid provided to the facility can be detrimental to equipment and the production operation.

A variety of systems and methods have been proposed for controlling or otherwise dealing with slugging. For example, the following methods are used in some conventional systems: (1) increasing the size of a primary separator that receives the production fluid from the riser so that the separator can handle the slugs, (2) increasing the back pressure on the riser with a topside control valve, (3) implementing a pressure control strategy via the topside automatic control valve, (4) using various combinations of the foregoing methods, (5) increasing the pressure at the riser, e.g., by employing a downhole pump in the well, (6) increasing the gas flow rate in the riser, e.g., by adding or increasing the gas in the riser or well, or (7) separating the gas and liquid at the base of the riser and allowing the gas to rise through a first riser while pumping the liquid to the surface in a separate, second riser.

While the foregoing methods can be useful for reducing the effects of slugging, each of the methods generally raises additional concerns and/or costs. For example, increasing the size of the separator can reduce some slugging; however, for increasingly deep and long risers, the size increases that are required for the separator can become impractical. The methods (2)-(5) above generally reduce the compressibility of the gas by increasing the pressure at the riser which, in turn, increases the rate at which gas pressure can build and overcome the hydrostatic head build up. Methods (2)-(4) above often result in increased backpressure and an unacceptable loss of production. Methods (5)-(7) above require the addition of energy and/or to the system and, consequently, depend upon the availability of sufficient power and/or gas.

Thus, a continued need exists for an improved system and method for slug control. The system and method should be capable of using the gas in the production fluid to provide at least some of the lift force required for transporting the fluid through the riser, and the system and method should be compatible with risers extending to great depths or lengths.

SUMMARY OF THE INVENTION

The embodiments of the present invention generally provide a riser-based slug control system and a method of controlling slugging. The system includes a gas-liquid separator, such as a gas-liquid cylindrical cyclone (GLCC) that can receive a production fluid, separate the production fluid into its liquid and gas phases, and provide an unobstructed path for the gas to the riser where it can blend with the liquid and aid in lifting the riser. The arrangement of the inlet and outlet ports reduces the flow's ability to form a liquid blockage and prevent flow of gas to the riser. When the gas flows unimpeded to the riser, severe slugging is not likely to occur and the liquid in the riser is lifted efficiently to the surface.

According to one embodiment of the present invention, the gas-liquid separator includes a housing that defines an internal volume. The separator also defines an inclined inlet that is connected to the housing and configured to receive a flow of multiphase fluid and direct the flow of fluid into the housing so that the fluid flows spirally in the volume and separates, with gas from the fluid collecting in an upper portion of the volume and liquid from the fluid collecting in a lower portion of the volume. The lower portion can be defined below the interface of the gas and liquid in the separator (i.e., the gas/liquid interface) and/or inlet, and the upper portion can be defined above the interface and/or the inlet. A tubular exit passage extends at least partially through the internal volume of the housing. The tubular passage defines a plurality of orifices in the volume and extends through a wall of the housing to an outlet. The pressure drop from gas flowing through the orifices in the upper section creates a low pressure in the tubular passage which draws liquid from the lower portion. The tubular passage and orifices are configured to receive liquid from the lower portion of the volume and gas from upper portion of the volume and deliver a mixture of the liquid and gas through the outlet and out of the housing, e.g., to the riser. For example, the orifices defined by the tubular passage can be disposed at a plurality of positions along the length of the tubular passage, and at least some of the orifices can be disposed in the lower portion of the volume of the housing so that the orifices are configured to receive liquid in the lower portion. The orifices are sized and spaced along the tubular passage to provide rough control of the liquid level in the vessel and avoid flooding the separator. Since the pressure drop from vessel inlet to riser inlet is the same for the gas passing through the upper orifices as it is for the liquid passing through the lower orifices, the liquid level must change to balance the pressure losses for each flow path. Properly sized and spaced, the orifices provide self regulated level control. The volume of the vessel allows the system to receive the moderate size slugs that may enter the riser without blocking the gas path to the riser.

According to one embodiment, the separator is located proximate a seafloor. A riser extends upward from the outlet of the separator so that the riser is configured to transport the mixture of the liquid and gas upward from the separator at the seafloor, e.g., to a topside separator or other facility.

The internal volume of the housing can be generally cylindrical and can define a longitudinal axis that extends vertically. The tubular passage can extend parallel to the longitudinal axis from a position within the lower portion of the volume and through a top side of the housing to the outlet. In some cases, the tubular passage extends along the longitudinal axis of the internal volume of the housing, and the tubular passage has a diameter that is smaller than the diameter of the housing.

In some cases, the system can be configured to provide additional energy for transporting the fluid. This system delays the onset requirement for external energy to lift liquid in the riser, e.g., gas lift or electric submersible pump and integrates easily once the lift system is required. For example, the housing can define an additional inlet, i.e., a gas inlet, that is configured to receive a pressurized gas into the upper portion of the volume to thereby provide more gas from the separator to the riser. In addition, or alternatively, a pump can be configured to pump the fluid. For example, the pump can be adapted to pump liquid from the lower portion of the volume of the housing through the tubular passage, and the tubular passage can define a plurality of the orifices in the upper portion of the volume of the housing so that the orifices are configured to receive gas in the upper portion and the gas is mixed with the liquid pumped through the tubular passage. The pump can be located in the lower portion of the housing and/or in the tubular passage. In some cases, a nozzle is disposed in the tubular passage and configured to decrease the pressure of the liquid pumped through the tubular passage at a position where the tubular passage is configured to receive gas from the upper portion of the housing.

According to one method of the present invention for controlling slugging in a fluid flowing through a riser, a flow of multiphase fluid is provided into a separator (e.g., a GLCC) via an inclined inlet connected to a housing of the separator so that the fluid flows spirally in an internal volume of the housing and separates. The liquid and gas are separated so that the liquid from the fluid collects in a lower portion of the volume (e.g., below the inlet) and the gas from the fluid collects in an upper portion of the volume (e.g., above the inlet). Liquid from the lower portion of the volume and gas from upper portion of the volume are received into a tubular passage that extends at least partially through the internal volume of the housing via a plurality of orifices defined by the tubular passage in the volume so that the tubular passage delivers a mixture of the liquid and gas to an inlet of the riser. For example, the orifices defined by the tubular passage can be provided at a plurality of positions along the tubular passage and the liquid can be received via at least some of the orifices that are disposed in the lower portion of the volume of the housing. The mixture is delivered through the riser, typically to a position higher than the separator. For example, the separator can be provided proximate a seafloor, and the riser can be provided to extend upward from the separator, so that the mixture of the liquid and gas is transported upward from the separator at the seafloor to a topside facility at the sea surface.

In some cases, additional energy can be provided for transporting the fluid. For example, a flow of pressurized gas can be delivered into the upper portion of the volume to thereby increase the pressure of the gas in the separator. The gas can be provided from a gas source located proximate the separator, at a topside facility proximate the top of the riser, or otherwise. In addition, or alternative, the liquid can be pumped from the lower portion of the volume of the housing through the tubular passage, e.g., by a pump located in the lower portion of the housing and in the tubular passage, and gas can be received into the tubular passage via a plurality of the orifices defined in the upper portion of the volume of the housing so that the gas is mixed with the liquid pumped through the tubular passage. In some cases, the liquid can be pumped through a nozzle disposed in the tubular passage to thereby decrease the pressure of the liquid pumped through the tubular passage at a position that is configured to receive gas from the upper portion of the housing.

BRIEF DESCRIPTION OF THE DRAWINGS

Figure 1:
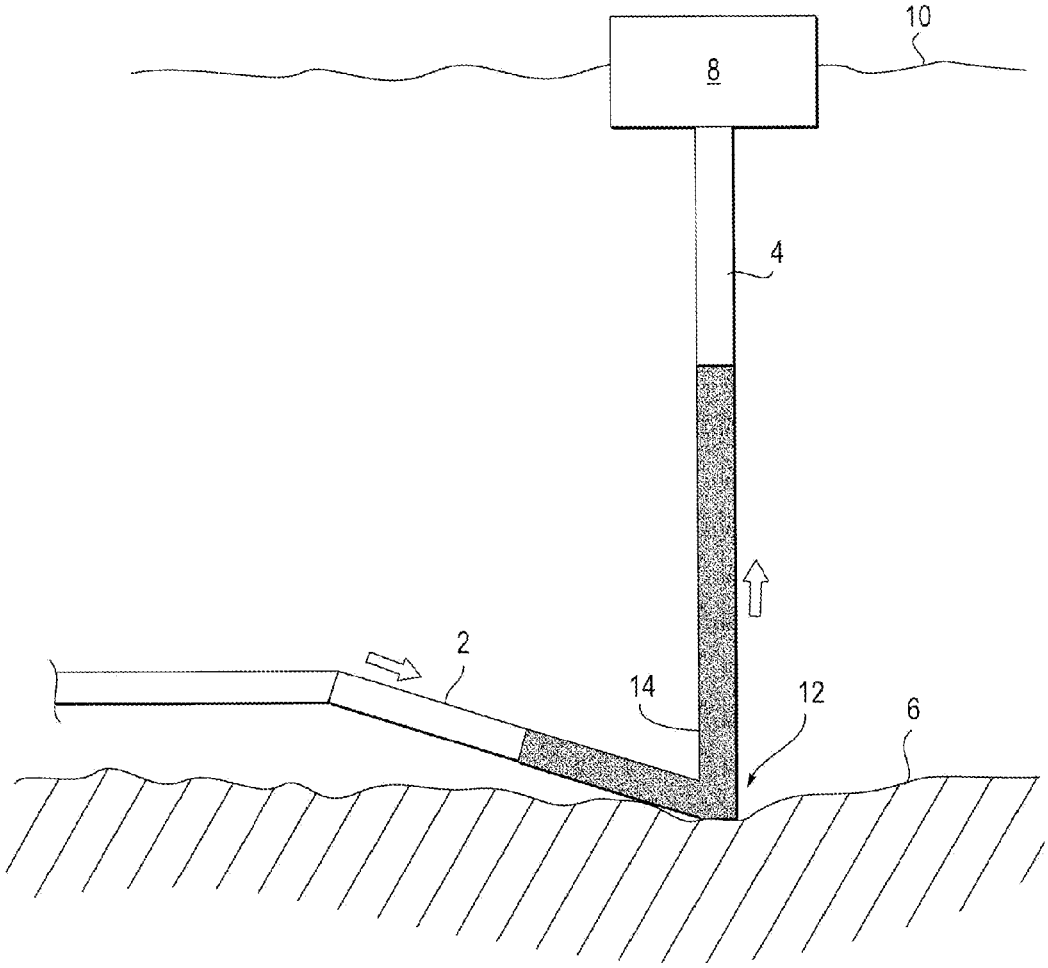
FIG. 1 (Prior Art)
Figure 2:
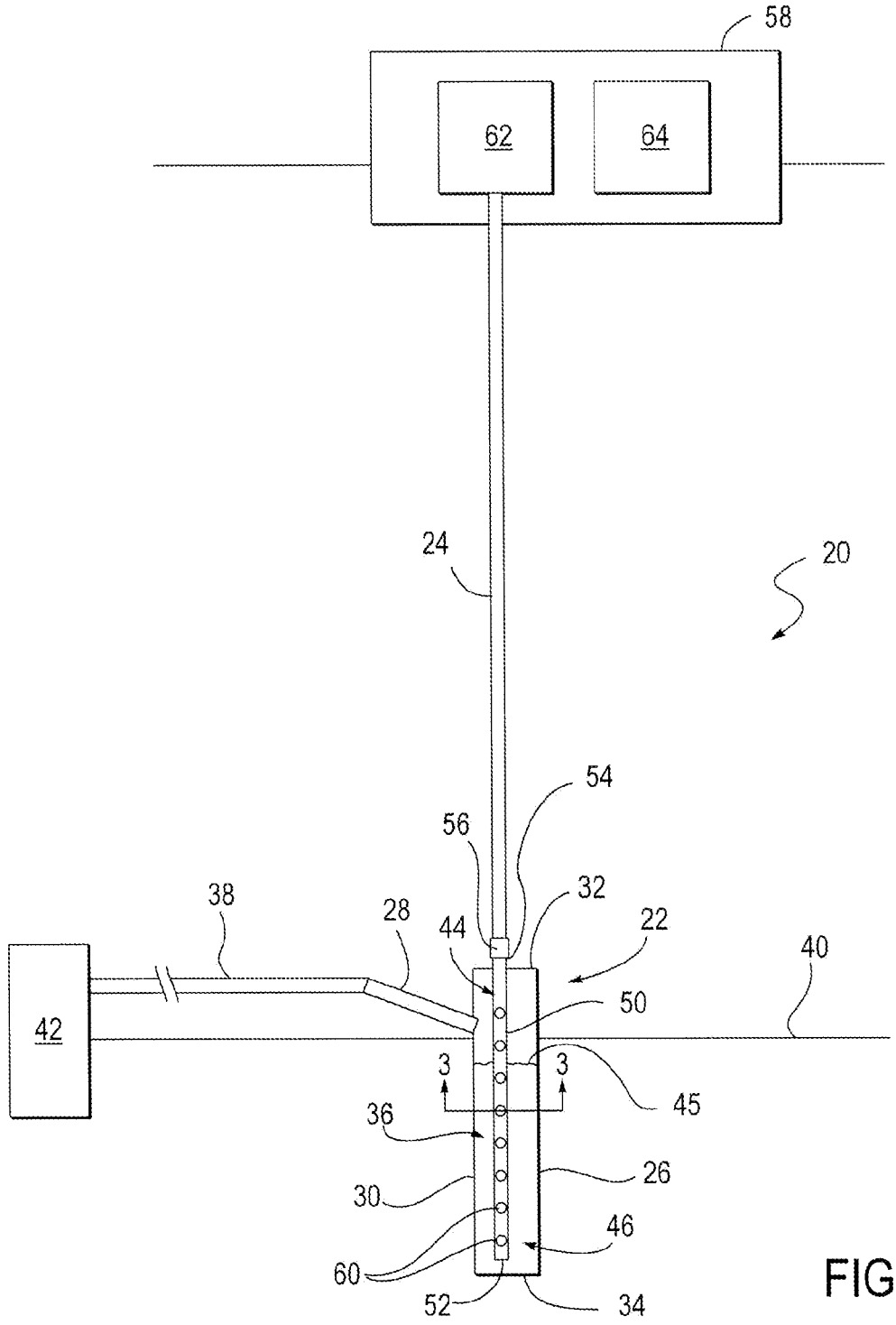
Figure 3:
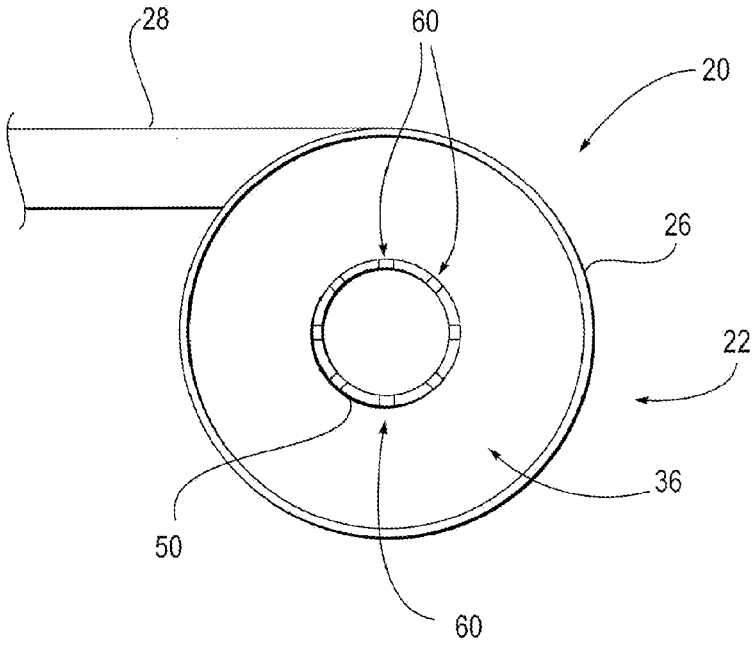
Figure 4:
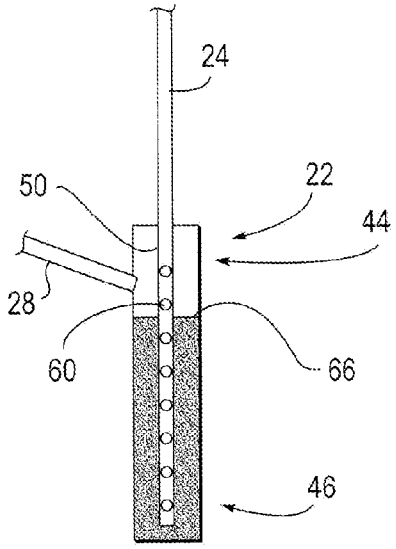
Figure 5:
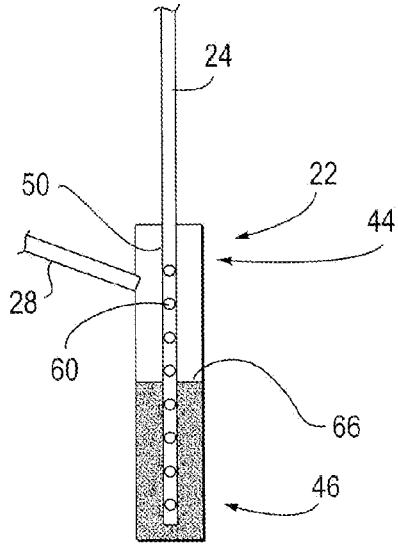
Figure 6:
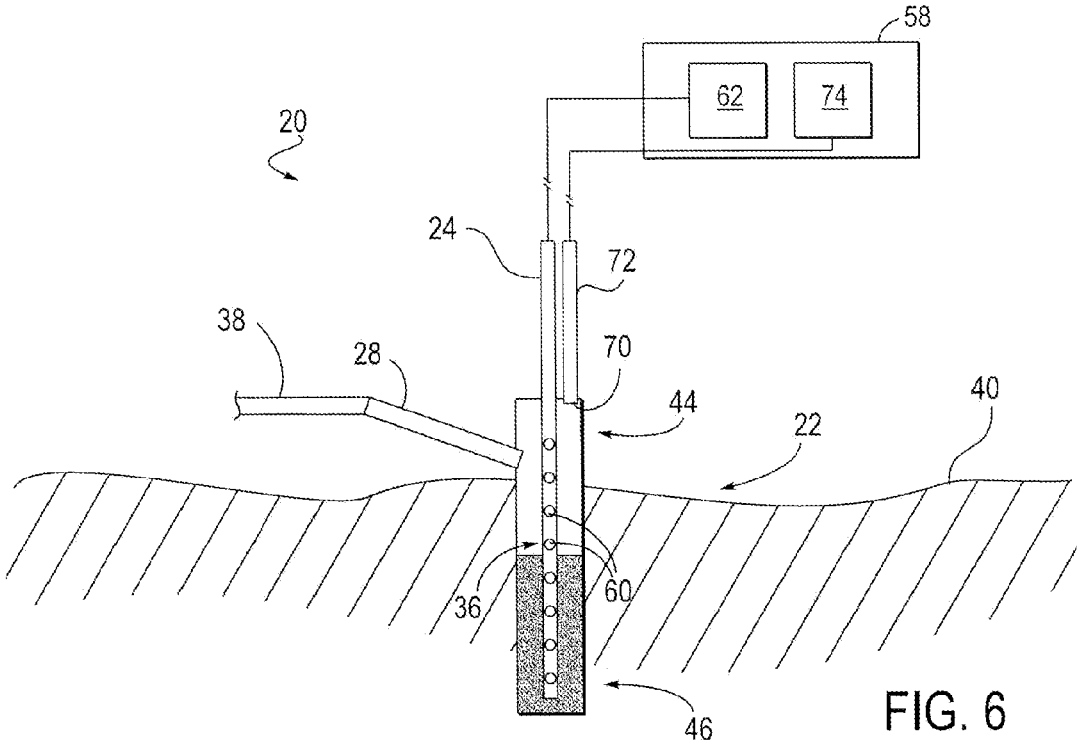
Figure 7:
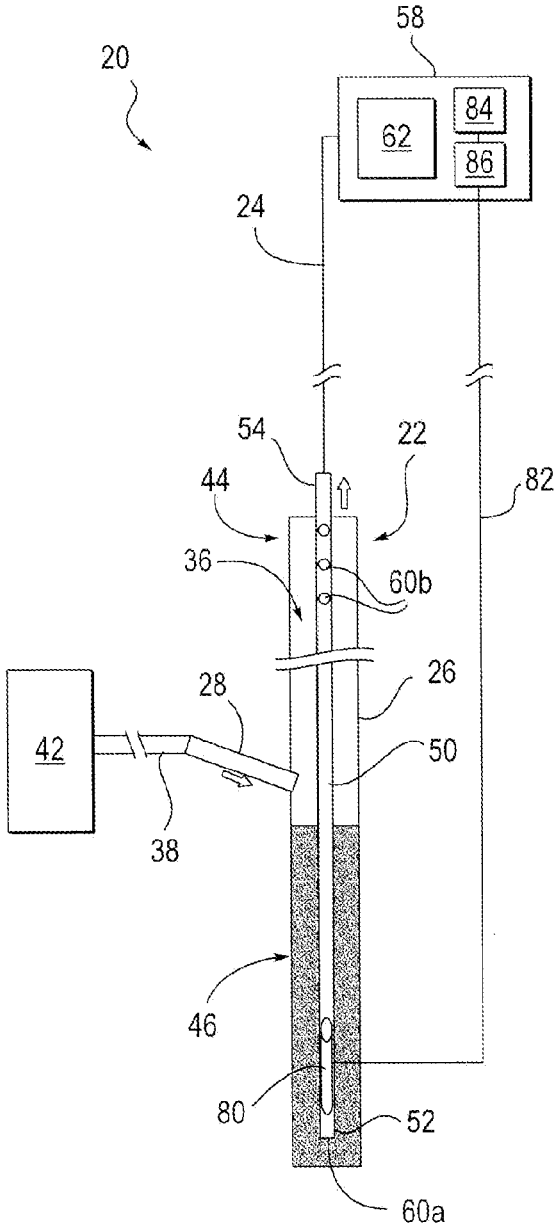
Figure 8:
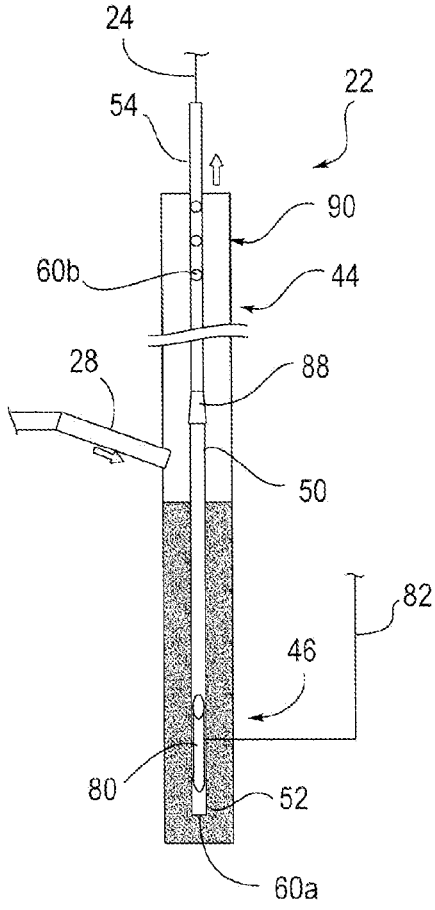

Having thus described the invention in general terms, reference will now be made to the accompanying drawings, which are not necessarily drawn to scale, and wherein:

FIG. 1 is a schematic view illustrating a typical slug formation in a conventional riser used to deliver hydrocarbons from a seafloor to a sea surface;

FIG. 2 is a schematic view illustrating a slug control system according to one embodiment of the present invention;

FIG. 3 is a section view illustrating the slug control system of FIG. 2 as seen along line 3-3 of FIG. 2;

FIGS. 4 and 5 are schematic views illustrating the slug control system of FIG. 2, shown partially filled with a liquid phase of a production fluid;

FIG. 6 is a schematic view illustrating a slug control system according to another embodiment of the present invention, including a gas inlet for receiving a pressurized lift gas;

FIG. 7 is a schematic view illustrating a slug control system according to another embodiment of the present invention, including a pump; and FIG. 8 is a schematic view illustrating a slug control system according to another embodiment of the present invention, including a pump and a nozzle for decreasing the pressure of the pumped liquid at a position where gas is received.

Figure 9:
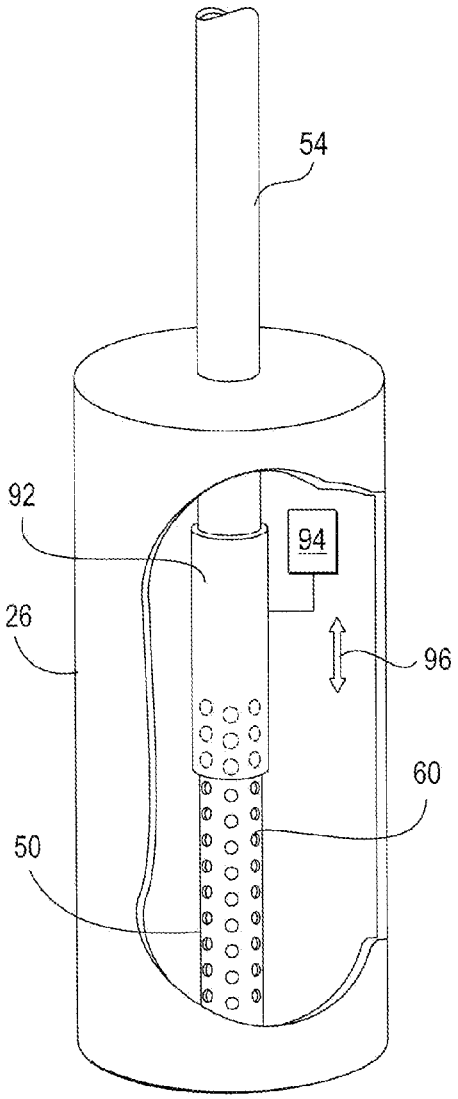
Figure 10:
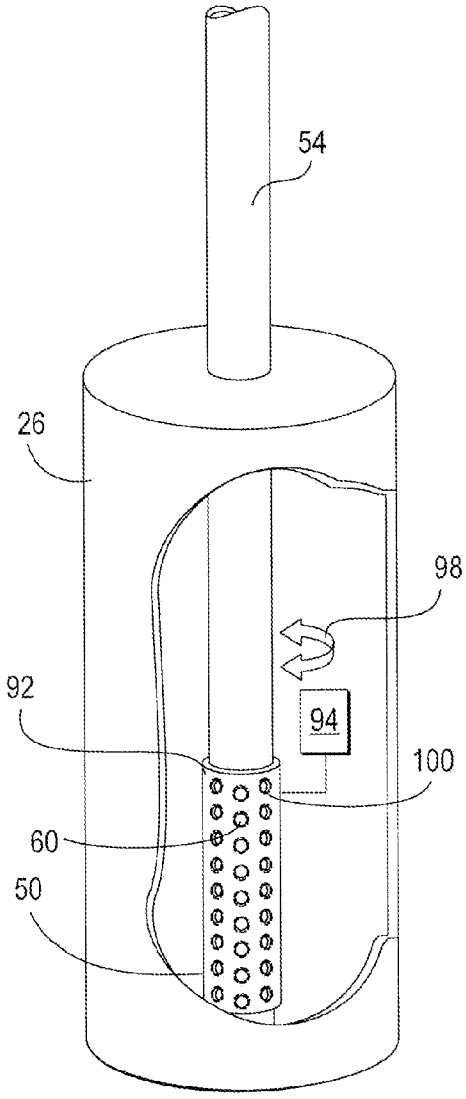

FIGS. 9 and 10 are schematic, partially cut-away views illustrating portions of a slug control system according to other embodiments of the present invention, each including a sleeve configured to adjustably open or close the orifices in the tubular passage.

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Referring now to the drawings and, in particular, to FIG. 2, there is shown a slug control system 20 according to one embodiment of the present invention. The system 20 generally includes a gas-liquid separator 22, which is configured to separate a multiphase production fluid (such as a fluid containing liquid hydrocarbons, water, natural gas, and/or other liquids or gases) and then recombine the liquid and gas phases of the fluid to form a mixture that is transported through a riser 24. More particularly, the separator 22 can be a gas-liquid cylindrical cyclone (GLCC) as shown in FIG. 2, which includes a housing 26 and an inclined inlet 28 connected to the housing 26. Similar to a conventional GLCC, the housing 26 can include a cylindrical sidewall 30 with top and bottom sides 32, 34 that together define a cylindrical internal volume 36. It is appreciated that other configurations can be used, e.g., top and/or bottom sides that have a configuration that is hemispherical, elliptical, or otherwise. Similar to the inlet 28 of a conventional GLCC, the inlet 28 is configured to receive a flow of multiphase production fluid and direct the flow of fluid into the housing 26 so that the fluid flows spirally in the volume 36 and separates into liquid and gas phases. As shown in FIG. 2, the separator 22 is configured to receive the production fluid from a production line 38, which is disposed on or near the seabase or seafloor 40 and connects to the output of a hydrocarbon well 42. As shown in FIG. 3, the inlet 28 is typically off-center from the longitudinal axis of the housing 26, e.g., so that the inlet 28 directs the flow of fluid along a path that is tangential to the cylindrical sidewall 30 of the housing 26.

The volume 36 of the housing 26 defines an upper portion 44 and a lower portion 46. The gas from the fluid collects in the upper portion 44, and the liquid from the fluid collects in the lower portion 46. The upper portion 44 is typically defined above the gas/liquid interface 45 and typically above the inlet 28, the lower portion 46 is typically defined below the gas/liquid interface 45 and typically below the inlet 28, and the volume 36 of the housing 26 can be large enough to receive a typical liquid slug from the production fluid into the lower portion 46 without blocking the inlet 28 or obstructing the flow of gas to the riser. It is appreciated that the separation of the gas may not be complete, such that the liquid that collects in the lower portion 46 of the volume 36 may contain some small amount of gas (e.g., less than 10%, and typically less than 5%, by weight of the liquid) and the gas that collects in the upper portion 44 of the volume 36 may contain some small amount of liquid (e.g., less than 50 gallons of liquid per million standard cubic feet (MMscf) of gas, and typically less than 10 gallons of liquid per MMscf of gas).

Unlike a conventional GLCC, which delivers the gas and liquid separately through two respective outlets, the system 20 shown in FIG. 2 is configured to deliver the gas and liquid as a mixture, e.g., through a single outlet. In particular, a tubular passage 50 extends through the wall of the housing 26 and at least partially through the internal volume 36 of the housing 26, e.g., from a first end 52 within the lower portion 46 of the internal volume 36, through the top side 32 of the housing 26, and to an outlet at a second end 54 disposed outside and above the housing 26. The tubular passage 50 can be formed as an integral part of the riser 24, i.e., as one continuous member with the riser 24, or the tubular passage 50 can be a separately formed member that is connected to the riser 24, e.g., by a connector 56. The tubular passage 50 can have a cylindrical configuration, as shown in FIG. 3, and can be parallel to the longitudinal axis of the volume 36 defined by the housing 26 of the separator 22, e.g., so that the tubular passage 50 extends vertically along the longitudinal axis of the housing 26. The tubular passage 50 defines a plurality of orifices 60 that are disposed in the volume 36 of the housing 26. For purposes of illustrative clarity, the orifices 60 are illustrated larger in FIG. 2 than the typical actual size of the orifices 60. It is appreciated that the orifices 60 can be provided in any number and size, e.g., according to the expected operational conditions of the system 20. In this regard, it is noted that in one typical steady-state condition of operation, the pressure drop through the orifices (i.e., from the outside of the tubular passage 50 to the inside of the tubular passage 50) is approximately equal to the pressure head due to the liquid in the tubular passage 50 (subject to frictional losses throughout the system 20). In one embodiment, each orifice 60 is between about 0.1 and 2 inches in diameter, and the tubular passage 50 defines between 2 and 100 orifices 60.

The orifices 60 are typically defined at a plurality of locations along the length of the tubular passage 50, e.g; with some or all of the orifices 60 defined in the lower portion 46 of the volume 36 of the housing 26. When the lower portion 46 of the housing 26 is filled with liquid and the upper portion 44 of the housing 26 is filled with gas, the orifices 60 in the lower portion 46 of the housing 26 are configured to receive the liquid and the orifices 60 in the upper portion 44 of the housing 26 are configured to receive the gas. Thus, the liquid and gas, which are generally separated in the separator 22, can flow unobstructed and recombine in the tubular passage 50. Further, the recombination of the liquid and gas provides a flow of a mixture of the liquid and gas that is delivered by the tubular passage 50 to the outlet at the second end 54 and the riser 24. In this way, the system 20 can increase the mixing of the liquid and gas and provide a mixture that can be more homogenous than the production fluid that enters the separator 22. In particular, if the production fluid entering the separator 22 contains a slug of liquid followed by a bubble of gas, the liquid and gas can both be received into the separator 22 and then mixed in the tubular passage 50 so that the mixture provided through the outlet at the second end 54 of the passage 50 to the riser 24 contains a more homogenous mixture, in which smaller gas bubbles are distributed throughout the liquid in the riser.

While the present invention is not limited to any particular theory of operation, it is believed that providing a continuous flow of gas to the riser distributed in relatively short bubbles, reduces the probability of liquid blocking the flow of gas to the riser, facilitates the flow of the mixture through the riser 24, and makes better use of the lift potential of the gas. That is, instead of the slug of liquid blocking the upstream flow of gas until the upstream pressure increases to overcome the liquid hydrostatic head, the separator can contain the slug without obstructing the flow of gas to the riser; the gas flowing through the orifices in the tubular creates a pressure drop that forces the liquid to push up in the tubular to a height above the gas orifices and thus the liquid is mixed with the gas and lifted to the surface in a continuous manner 24. In this way, the occurrence of slugging in the fluid can be reduced so that the production fluid is transported through the riser 24 at a more uniform flow rate and pressure. It is appreciated that the nature and extent of mixing can affect the efficiency of the gas in lifting the mixture. For example, in some cases, relatively larger, unmixed gas bubbles can be more efficient than smaller, well mixed bubbles.

The system 20 illustrated in FIG. 2 is configured as a riser-based slug control system, i.e., a system in which the separator 22 is connected to a lower end of the riser 24 that provides a passageway for production fluid that is transported from the slug control system 20 to a topside facility 58. For example, the system 20 can separate the multiphase production fluid, mix the liquid and gas, and deliver the mixture through the riser 24 to a separator 62 and/or other processing equipment 64 in the topside facility 58. In this configuration, the pinch point that is defined between the production line and the riser in a conventional system (such as the pinch point 12 shown in FIG. 1) can be replaced by the separator 22. With the pinch point eliminated in this way, a normal flow fluctuation or liquid slug cannot form a blockage at the pinch point. Further, the separator 22 automatically controls the amount of liquid and gas injected into the riser 24, thereby avoiding slugging. In this regard, it is noted that the slug control system 20 of FIG. 2 generally prevents a liquid blockage from forming between the production line 38 and the riser 24 and provides an uninterrupted path to the riser 24, i.e., a path along which the gas can flow even if a slug of liquid is delivered through the production line 38 and received into the separator 22.

While FIG. 2 illustrates a riser-based control system 20, in other embodiments, the slug control system 20 can be configured to receive a flow of multiphase fluid at another location and/or deliver the mixed fluid to a riser or other line. In addition, it is appreciated that the control system 20 can be located on the seafloor 40, as shown in FIG. 2, or at other locations, e.g., at the inlet of a riser or other line that delivers the mixed fluid to a facility, which is typically at a higher elevation than the separator 22. Further, while the separator 22 illustrated in FIG. 2 is a GLCC, the volume 36 of the separator 22 can instead be defined by another structure, such as an underwater caisson.

The operation of the system 20 is further illustrated in FIGS. 4 and 5, which show the separator 22 with different amounts of liquid and gas therein. In FIG. 4, the top level 66 of the liquid is relatively high in the separator 22, e.g., as might occur immediately after the separator 22 receives a slug of fluid from the production line 38 via the inlet 28. In this case, most of the orifices 60 defined by the tubular passage 50 are in communication with the liquid in the lower portion 46 of the volume 36 of the separator 22 and configured to receive the liquid, while a relatively lesser number of the orifices 60 are configured to receive the gas in either the upper or lower portions 44, 46 of the volume 36. The pressure of the gas in the upper portion 44 of the separator 22 provides a force on the liquid to push the liquid into the orifices 60. Also, the lift force of the gas rising in the tubular passage 50 provides a force on the liquid to lift the liquid in the tubular passage 50 and pull more liquid through the orifices 60 into the tubular passage 50.

In FIG. 5, the top level 66 of the liquid is relatively lower in the separator 22, e.g., as might occur after a slug of liquid has been mixed with gas and delivered through the tubular passage 50 and/or immediately after the separator 22 receives a bubble of gas from the production line 38. In this case, a lesser number of the orifices 60 are in communication with the liquid in the lower portion 46 of the volume 36 of the separator 22 and configured to receive the liquid. Relative to the case of FIG. 4, a greater number of the orifices 60 are configured in FIG. 5 to receive the gas in the upper portion 44 of the volume 36. As explained above in connection with FIG. 4, the liquid in the separator 22 is pushed into the tubular passage 50 by the pressure exerted by the gas in the upper portion 44 of the separator 22, and the liquid is lifted by the gas rising in the tubular passage 50.

The tubular passage 50 tends to receive more gas when the number of orifices 60 exposed to the gas is increased, and the tubular passage 50 tends to receive more liquid when the number of orifices 60 exposed to the liquid gas is increased. Thus, the system 20 can automatically regulate itself by delivering more liquid when the top level 66 of the liquid is high and delivering less liquid when the top level 66 of the liquid is low; however, even when the liquid level is relatively high, as shown in FIG. 4, the gas is not blocked from the tubular passage 50 but instead continues to flow and facilitate the continued flow of liquid.

During one typical method of operation of the system 20 of FIGS. 2-5, the level of liquid in the separator 22 and the rates of flow of the liquid and gas from the separator 22 into the riser 24 can adjust automatically. In other words, the level of liquid and the flow rates can change according to the operating parameters of the system 20, such as the content and flow conditions of the production fluid entering the separator 22, and without user intervention. For example, if the production fluid entering the separator 22 is stratified, such that the flow of production fluid includes a continuous flow of liquid and gas into the separator 22, then the gas accumulates in the upper portion 44 of the volume 36 of the separator 22 and the liquid accumulates in the lower portion 46. The compressed gas in the upper portion 44 exerts a force on the liquid and pushes the liquid in the lower portion 46 through the orifices 60 and into the tubular passage 50 and riser 24. If the liquid level in the separator 22 is relatively high, the liquid flows through a greater number of orifices 60 so that the flow of liquid into the tubular passage 50 is relatively greater and the flow of gas into the tubular passage 50 is relatively lesser. As the liquid level falls in the separator 22, the liquid flows through fewer orifices 60 and the gas flows through more orifices 60 so that the flow of liquid into the tubular passage 50 is relatively lesser and the flow of gas into the tubular passage 50 is relatively greater.

If, instead of a stratified flow of liquid and gas, the production fluid includes a liquid slug that flows into the separator 22, the liquid level in the separator 22 will rise while the liquid accumulates in the separator 22. The increase in liquid in the separator 22 results in a smaller flow of gas through the orifices 60. If a bubble of gas is then provided through the production line 38 and into the separator 22, the flow of gas into the separator 22 exceeds the flow of gas out of the separator 22 so that the liquid level in the separator 22 falls. Thus, regardless of whether the flow into the separator 22 is a stratified flow or a series of slugs and bubbles, the system 20 can provide a flow into the riser 24 that is characterized as a bubbly mixture of gas and liquid or, alternatively, a series of slugs that are lifted by the gas in the riser 24 and that are small enough to avoid severe slugging in the riser 24.

In this way, the flow rates of the liquid and gas can adjust and automatically achieve a particular liquid level in the separator 22. The size of the separator 22, configuration of the orifices 60, and other characteristics of the system 20 can be configured to accommodate liquid slugs and gas bubbles of particular sizes so that, when a gas bubble follows a liquid slug, the gas lifts most or all of the accumulated liquid from the separator 22 into the riser 24 before another slug enters the separator 22. For example, in some embodiments, the height of the separator 22 can be between about 10 and 300 feet, and the diameter of the separator 22 can be between about 1 and 5 feet. The diameter of the tubular passage 50 is typically significantly smaller than the diameter of the housing 26. For example, the diameter of the housing 26 of the separator 22 can be about 3 feet, and the diameter of the tubular passage 50 can be about 1 foot. In one embodiment, the diameter of the housing 26 is about 2-3 times as great as the diameter of the production line 38. If the system 20 is disposed in water, the separator 22 can be positioned at least partially below the mudline at the seafloor 40. The sizes of the orifices 60 can vary, as discussed above, and can be configured in size and number to provide a predetermined pressure drop between the outside and the inside of the tubular passage 50 and thereby facilitate the maintenance of a particular liquid level in the separator 22.

In some cases, additional energy can be provided to the system 20 to facilitate the lifting of the production fluid through the riser 24. For example, as shown in FIG. 6, the separator 22 can define a gas inlet 70 connected to the upper portion 44 of the volume 36 of the separator 22, i.e., through the top side 32. The gas inlet 70 can be connected by a pipe, hose, or other tubular passage 72 to a source 74 of pressurized gas. The source 74 of pressurized gas can include a compressor located in the topside facility 58, a vessel filled with compressed gas located at the topside facility 58 or on the seafloor 40, or another source of compressed gas. In either case, the compressed gas can be delivered to the upper portion 44 of the volume 36, thereby increasing the volume 36 and/or pressure of gas flowing through the separator 22. In this way, the pressurized gas can facilitate the lifting of the production fluid through the riser 24.

It will be appreciated that the provision of pressurized gas may be more advantageous if the production fluid from the well 42 contains little gas. In some cases, the pressurized gas can be provided only when the gas content of the production fluid is insufficient for lifting the production fluid and/or when the gas content falls below a particular threshold. For example, in early stages of operation of the well 42, the production fluid may contain sufficient gas such that no additional pressurized gas is required. In later stages of operation of the well 42, the gas content may be lower, and additional pressurized gas may be beneficial or necessary for lifting the production fluid. In some cases, the system 20 can be configured to operate without the use of added pressurized gas and subsequently retrofitted to provide pressurized gas.

Additional energy for lifting the production fluid can also be provided in other manners. For example, FIG. 7 illustrates another embodiment in which a pump 80 is provided for facilitating the lifting of the production fluid through the riser 24. The pump 80 can be an electrical submersible pump (ESP), and the pump 80 can be positioned in the volume 36 of the separator 22, e.g., in the lower portion 46 and within the tubular passage 50 as shown in FIG. 7. In other cases, the pump 80 can be located outside the tubular passage 50 and/or outside the volume 36 of the separator 22. If the pump 80 is an electrical device, such as an ESP, electrical power can be provided via an electrical connection 82 that extends from the pump 80 to a power source 84 at the topside facility 58 or to another source of electrical power on the seafloor 40 or elsewhere. A controller 86 can also be provided for controlling the power to the pump 80 and/or otherwise controlling the speed or other operation of the pump 80. Note that FIGS. 7 and 8 do not illustrate the full height of the separator 22. In some cases, a subsea GLCC or other separator 22 can be connected to a caisson, which can be sunk in the seafloor as a dummy well, forming a separator that is very tall, e.g., 300 feet.

In the embodiment of FIG. 7, the first, lower end 52 of the tubular passage 50 is open to define a relatively large orifice or inlet 60*a* for receiving the liquid from the lower 46 portion of the volume 36 of the separator 22. The tubular passage 50 also defines a plurality of the smaller orifices 60*b* in the upper portion 44 of the volume 36 for receiving the gas. The pump 80 is adapted to pump liquid from the lower portion 46 of the volume 36 of the housing 26 through the tubular passage 50. More particularly, during operation, the pump 80 draws liquid into the inlet 60*a* at the bottom of the tubular passage 50 and pumps the liquid upward to the outlet at the second end 54 of the passage 50 and into the riser 24. Gas in the upper portion 44 of the volume 36 of the separator 22 can enter the tubular passage 50 via the orifices 60*b* in the upper portion 44 of the volume 36. In the embodiment of FIG. 7, the large orifice or inlet 60*a* at the bottom of the tubular passage 50 is the only orifice defined in the lower portion 46 of the volume 36. The other, smaller orifices 60*b* are defined solely in the upper portion 44 of the volume 36 for receiving the gas from the upper portion 44. The gas that enters the tubular passage 50 through the orifices 60*b* mixes with the liquid and can provide additional lift force for lifting the production fluid through the riser 24. The gas from the upper portion 44 of the volume 36 typically flows into the tubular passage 50 when the pressure of the gas in the upper portion 44 is greater than the pressure in the riser 24.

As described above, additional lift may not be required at all times of operation or throughout all phases of the life of the well 42. Therefore, in some cases, the pump 80 can be selectively operated only at particular times, e.g., when the production fluid contains a relatively small amount of gas, and/or the system 20 can be implemented without the pump 80 and subsequently retrofitted to include the pump 80, e.g., during later stages of operation of the well 42 when the production fluid provides less gas or pressure.

FIG. 8 illustrates another embodiment in which the pump 80 is provided for facilitating the lifting of the production fluid through the riser 24. In addition, the configuration of FIG. 8 includes a nozzle 88 that is disposed in the tubular passage 50. The nozzle 88, which is positioned downstream of the pump 80 in FIG. 8, is configured to increase the speed of the liquid through the tubular passage 50, and thereby decrease the pressure of the liquid downstream of the nozzle 88 at a position 90 where the orifices 60*b* are defined in the upper portion 44, i.e., the position 90 where the tubular passage 50 is configured to receive gas from the upper portion 44 of the housing 26. By decreasing the pressure of the liquid in the tubular passage 50 at the position of the orifices 60*b*, the entry of the gas into the tubular passage 50 can be facilitated. Thus, if the pressure of the liquid delivered through the tubular passage 50 is increased, e.g., by increasing the operational speed of the pump 80, the pressure downstream of the nozzle 88 can nevertheless be decreased so that gas is received into the tubular passage 50. In this way, the system 20 can have a self-regulating effect, by increasing the amount of gas that is delivered through the riser 24 when the speed of the pump 80 is increased.

Valves (not shown) can be provided for controlling the flow of fluids into and out of the separator 22. In addition, or alternative, the tubular passage 50 can be adjustable in one or more ways, either before or during operation. For example, the tubular passage 50 can be adjustably connected to the housing 26 of the separator 22 so that the tubular passage 50, and hence the orifices 60, can be adjustable in the separator 22. The size and/or number of the orifices 60 can also be adjustable, e.g., by providing a sleeve inside or outside of the tubular passage 50 that is slidably adjustable along the axis of the tubular passage 50, the sleeve defining orifices 60 that are adjustably registered with the orifices 60 of the tubular passage 50 to effectively adjust the size of the orifices 60 through which the liquid and gas can flow into the tubular passage 50. For example, as shown in FIG. 9, the tubular passage 50 is fixedly positioned in the housing 26 and a sleeve 92 is slidably adjustable along the axis of the tubular passage 50 and configured to be adjusted by an actuator 94 in directions 96 so that the sleeve 92 can selectively positioned to cover or expose any number of the orifices 60 and thereby change the resistance to flow through the orifices 60 and, hence, the pressure drop across the orifices 60. In another embodiment, shown in FIG. 10, the sleeve 92 is rotatably adjustable about the axis of the tubular passage 50 and configured to be rotated by the actuator 94 in directions 98. Further, the sleeve 92 defines orifices 100 that correspond in location to the orifices 60 of the tubular passage 50 so that the sleeve 92 can be rotated to selectively cover or expose any portion of the orifices 100 and thereby change the resistance to flow through the orifices 60.

Many modifications and other embodiments of the inventions set forth herein will come to mind to one skilled in the art to which these inventions pertain having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A riser-based slug control system comprising:

a gas-liquid separator comprising a housing defining an internal volume, and an inclined inlet connected to the housing and configured to receive a flow of multiphase fluid and direct the flow of fluid into the housing such that the fluid flows spirally in the volume and separates, with gas from the fluid collecting in an upper portion of the volume and liquid from the fluid collecting in a lower portion of the volume; and a tubular passage extending at least partially through the internal volume of the housing, the tubular passage defining a plurality of orifices in the volume, and the tubular passage extending through a wall of the housing to an outlet, such that the tubular passage is configured to receive liquid from the lower portion of the volume and gas from upper portion of the volume and deliver a mixture of the liquid and gas through the outlet.

2. A system according to claim 1 wherein the separator is a gas-liquid cylindrical cyclone configured to receive slugs in the multiphase fluid.

3. A system according to claim 1 wherein the separator is located proximate a seafloor, and further comprising a riser extending upward from the outlet, such that the riser is configured to transport the mixture of the liquid and gas upward from the separator at the seafloor.

4. A system according to claim 1 wherein the internal volume of the housing is generally cylindrical and defines a longitudinal axis that extends vertically, and the tubular passage extends parallel to the longitudinal axis from a position within the lower portion of the volume and through a top side of the housing to the outlet.

5. A system according to claim 4 wherein the tubular passage extends along the longitudinal axis of the internal volume of the housing.

6. A system according to claim 5 wherein the tubular passage has a diameter smaller than a diameter of the housing.

7. A system according to claim 1 wherein the lower portion is defined below the inlet and the upper portion is defined above the inlet.

8. A system according to claim 1 wherein the orifices defined by the tubular passage are disposed at a plurality of positions along the tubular passage and at least some of the orifices are disposed in the lower portion of the volume of the housing such that the orifices are configured to receive liquid in the lower portion.

9. A system according to claim 1 wherein the housing further defines a gas inlet configured to receive a pressurized gas into the upper portion of the volume to thereby increase the pressure of the gas in the separator.

10. A system according to claim 1, further comprising a pump adapted to receive liquid from the lower portion of the volume of the housing and pump the liquid through the tubular passage, and wherein the tubular passage defines a plurality of the orifices in the upper portion of the volume of the housing, that the orifices being configured to receive gas in the upper portion such that the gas is mixed with the liquid pumped through the tubular passage.

11. A system according to claim 10 wherein the pump is located in the lower portion of the housing and in the tubular passage.

12. A system according to claim 10, further comprising a nozzle disposed in the tubular passage and configured to decrease the pressure of the liquid pumped through the tubular passage at a position configured to receive gas from the upper portion of the housing.

13. A method of controlling slugging in a fluid flowing through a riser, the method comprising:

providing a flow of multiphase fluid into a separator via an inclined inlet connected to a housing of the separator such that the fluid flows spirally in an internal volume of the housing and separates, with gas from the fluid collecting in an upper portion of the volume and liquid from the fluid collecting in a lower portion of the volume;

receiving liquid from the lower portion of the volume and gas from upper portion of the volume into a tubular passage extending at least partially through the internal volume of the housing via a plurality of orifices defined by the tubular passage in the volume and thereby mixing the liquid and gas in the tubular passage to form a mixture of the liquid and gas; and delivering the mixture from the tubular passage through the riser to a position higher than the separator.

14. A method according to claim 13 wherein the step of providing the flow of multiphase fluid comprises providing slugs in the multiphase fluid and wherein the steps of receiving the liquid and delivering the mixture comprise increasing the mixing of the liquid and gas of the fluid to thereby reduce the slugging in the fluid.

15. A method according to claim 13, further comprising providing the separator proximate a seafloor, and providing the riser extending upward from the separator, wherein delivering the mixture through the riser comprises transporting the mixture of the liquid and gas upward from the separator at the seafloor to a position proximate the sea surface.

16. A method according to claim 13, further comprising providing the housing having a generally cylindrical configuration and defining a longitudinal axis that extends vertically, and providing the tubular passage extending parallel to the longitudinal axis from a position within the lower portion of the volume and through a top side of the housing to the riser.

17. A method according to claim 16 wherein the step of providing the tubular passage comprises providing the tubular passage extending along the longitudinal axis of the internal volume of the housing.

18. A method according to claim 17 wherein the step of providing the tubular passage comprises providing the tubular passage with a diameter smaller than a diameter of the housing.

19. A method according to claim 13 wherein the step of providing the flow of multiphase fluid into the separator comprises separating the fluid such that the gas from the fluid collects in the upper portion defined above an interface of the gas and liquid in the separator and the liquid from the fluid collects in the lower portion defined below the interface.

20. A method according to claim 13, further comprising providing the plurality of orifices defined by the tubular passage at a plurality of positions along the tubular passage and wherein said receiving step comprises receiving the liquid via at least some of the orifices disposed in the lower portion of the volume of the housing.

21. A method according to claim 13, further comprising delivering a flow of pressurized gas into the upper portion of the volume to thereby increase the pressure of the gas in the separator.

22. A method according to claim 13, further comprising pumping the liquid from the lower portion of the volume of the housing through the tubular passage, and wherein the receiving step comprises receiving gas into the tubular passage via a plurality of the orifices defined in the upper portion of the volume of the housing and thereby mixing the gas with the liquid pumped through the tubular passage.

23. A method according to claim 22 wherein said pumping step comprises pumping the liquid with a pump located in the lower portion of the housing and in the tubular passage.

24. A method according to claim 22 wherein said pumping step comprises pumping the liquid through a nozzle disposed in the tubular passage and thereby decreasing the pressure of the liquid pumped through the tubular passage at a position configured to receive gas from the upper portion of the housing.

* * * * *